US010612113B2

(12) United States Patent
Schulz et al.

(10) Patent No.: US 10,612,113 B2
(45) Date of Patent: Apr. 7, 2020

(54) MICRO-ALLOYED HIGH-STRENGTH MULTI-PHASE STEEL CONTAINING SILICON AND HAVING A MINIMUM TENSILE STRENGTH OF 750 MPA AND IMPROVED PROPERTIES AND METHOD FOR PRODUCING A STRIP FROM SAID STEEL

(71) Applicant: SALZGITTER FLACHSTAHL GMBH, Salzgitter (DE)

(72) Inventors: Thomas Schulz, Salzgitter (DE); Marion Calcagnotto, Braunschweig (DE); Sascha Kluge, Salzgitter (DE); Sebastian Westhäuser, Braunschweig (DE); Tobias Klinkberg, Braunschweig (DE); Thorsten Michaelis, Lengede (DE)

(73) Assignee: SALZGITTER FLACHSTAHL GMBH, Salzgitter (DE)

( * ) Notice: Subject to any disclaimer, the term of this patent is extended or adjusted under 35 U.S.C. 154(b) by 0 days.

(21) Appl. No.: 16/007,310

(22) Filed: Jun. 13, 2018

(65) Prior Publication Data

US 2018/0298476 A1 Oct. 18, 2018

Related U.S. Application Data

(62) Division of application No. 14/908,471, filed as application No. PCT/DE2014/000295 on May 27, 2014, now abandoned.

(30) Foreign Application Priority Data

Jul. 30, 2013 (DE) ..... 10 2013 013 067

(51) Int. Cl.
*C22C 38/38* (2006.01)
*C21D 8/02* (2006.01)
(Continued)

(52) U.S. Cl.
CPC ..... *C22C 38/38* (2013.01); *C21D 1/26* (2013.01); *C21D 1/76* (2013.01); *C21D 1/84* (2013.01);
(Continued)

(58) Field of Classification Search
CPC ..... C21D 8/0278; C21D 9/52; C21D 9/573; C21D 2211/002; C21D 2211/005;
(Continued)

(56) References Cited

U.S. PATENT DOCUMENTS 5,953,946 A * 9/1999 Mucke ..... B21D 1/05 72/160
2006/0144482 A1* 7/2006 Moulin ..... C21D 8/0236 148/603
(Continued)

FOREIGN PATENT DOCUMENTS

CN 102747272 A * 10/2012
DE 196 10 675 C1 2/1997
(Continued)

OTHER PUBLICATIONS

Speich, G. R., and W. C. Leslie. "Tempering of steel." Metallurgical Transactions 3.5 (1972): 1043-1054 (Year: 1972).*
(Continued)

*Primary Examiner* — Anthony J Zimmer
*Assistant Examiner* — Ricardo D Morales
(74) *Attorney, Agent, or Firm* — Henry M. Feiereisen LLC

(57) ABSTRACT

A high-strength multi-phase steel having minimum tensile strengths of 750 MPa and preferably having a dual-phase microstructure for a cold- or hot-rolled steel strip, in particular for lightweight vehicle construction is disclosed. The high-strength multi-phase steel has improved forming properties and a ratio of yield point to tensile strength of at most
(Continued)

| Steel | Variant / Method | Thickness | Hole expansion ratio Relative to comparative grade | Hole expansion ratio According to ISO 16630 |
|---|---|---|---|---|
| Comparative grade | A, 2 | 1.00 mm | 100% | 25% |
| | A, 3 | 1.00 mm | 100% | 30% |
| Invention | A, 2 | 1.00 mm | 180% | 45% |
| | A, 3 | 1.00 mm | 257% | 77% |
| Comparative grade | B, 2 | 2.00 mm | 100% | 21% |
| | B, 3 | 2.00 mm | 100% | 31% |
| Invention | B, 2 | 2.00 mm | 171% | 36% |
| | B, 3 | 2.00 mm | 132% | 41% |
| Note: average value of at least 4 tests, punched holes $D_0$=10 mm | | | | |

73%. The high-strength multi-phase steel includes in mass %: C≥0.075 to ≤0.105; Si≥0.600 to ≤0.800; Mn≥1.000 to ≤0.700; Cr≥0.100 to ≤0.480; Al≥0.010 to ≤0.060; N 0.0020≤0.0120; S≤0.0030; Nb≥0.005 to ≤0.050; Ti≥0.0050 to ≤0.050; B≥0.0005 to ≤0.0040; Mo≤0.200; Cu≤0.040%; Ni≤0.040 % the remainder iron, including typical elements accompanying steel that are not mentioned above, which represent contamination resulting from smelting.

14 Claims, 7 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C21D 1/26*** | (2006.01) |
| ***C21D 1/76*** | (2006.01) |
| ***C21D 1/84*** | (2006.01) |
| ***C21D 6/00*** | (2006.01) |
| ***C21D 9/52*** | (2006.01) |
| ***C21D 9/573*** | (2006.01) |
| ***C23C 2/02*** | (2006.01) |
| ***C23C 2/06*** | (2006.01) |
| ***C23C 2/26*** | (2006.01) |
| *C21D 9/46* | (2006.01) |

(52) U.S. Cl.
CPC ..... *C21D 6/002* (2013.01); *C21D 6/005* (2013.01); *C21D 6/008* (2013.01); *C21D 8/0205* (2013.01); *C21D 8/0221* (2013.01); *C21D 8/0226* (2013.01); *C21D 8/0236* (2013.01); *C21D 8/0263* (2013.01); *C21D 8/0273* (2013.01); *C21D 8/0278* (2013.01); *C21D 9/52* (2013.01); *C21D 9/573* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C23C 2/02* (2013.01); *C23C 2/06* (2013.01); *C23C 2/26* (2013.01); *C21D 9/46* (2013.01); *C21D 2211/002* (2013.01); *C21D 2211/005* (2013.01); *C21D 2211/008* (2013.01)

(58) Field of Classification Search
CPC ... C21D 2211/008; C21D 9/46; C22C 38/001; C22C 38/002; C22C 38/02; C22C 38/04; C22C 38/06; C22C 38/22; C22C 38/24; C22C 38/26; C22C 38/28; C22C 38/32; C23C 2/02; C23C 2/06; C23C 2/26
See application file for complete search history.

(56) References Cited

U.S. PATENT DOCUMENTS

| | | | | |
|---|---|---|---|---|
| 2010/0104891 | A1* | 4/2010 | Nakagaito | C22C 38/02 428/659 |
| 2011/0008546 | A1* | 1/2011 | Suzuki | C21D 8/0273 427/431 |
| 2011/0217569 | A1* | 9/2011 | Fushiwaki | C22C 38/02 428/659 |
| 2012/0282487 | A1* | 11/2012 | Ogawa | C21D 8/0426 428/659 |
| 2013/0133786 | A1* | 5/2013 | Matsuda | C21D 1/22 148/533 |
| 2015/0034218 | A1* | 2/2015 | Krizan | C21D 8/0226 148/623 |

FOREIGN PATENT DOCUMENTS

| | | | | |
|---|---|---|---|---|
| DE | 100 37 867 | A1 | | 6/2001 |
| EP | 1 548 142 | A1 | | 6/2005 |
| EP | 1 918 406 | A1 | | 5/2008 |
| EP | 2 031 081 | A1 | | 3/2009 |
| EP | 2 128 295 | A1 | | 12/2009 |
| EP | 2 138 599 | A1 | | 12/2009 |
| EP | 2 412 842 | A1 | | 2/2012 |
| JP | 2001207235 | A | * | 7/2001 |
| JP | 2004 250774 | A | | 9/2004 |
| JP | 2005 105361 | A | | 4/2005 |

OTHER PUBLICATIONS

Blejde, Walter, Rama Mahapatra, and Hishahiko Fukase. "Development of low carbon thin strip production capability at Project" M"." Iron and Steelmaker(USA) 27.4 (2000): 29-33 (Year: 2000).*
International Search Report issued by the European Patent Office in International Application PCT/DE2014/000295.

* cited by examiner

| Option | Element | C % | Si % | Mn % | P % | S % | N % | Al % | Cr % | Mo % | Ti % | V % | Nb % | B % | CEV (IWW) | CET | Pcm | Summa Si+Mn+Cr % |
|---|---|---|---|---|---|---|---|---|---|---|---|---|---|---|---|---|---|---|
| | | | | | | | | | | | | | | | | | | |
| Invention | | 0,091 | 0,705 | 1,801 | 0,010 | 0,003 | 0,0054 | 0,035 | 0,344 | 0,011 | 0,016 | 0,001 | 0,016 | 0,0031 | 0,47 | 0,29 | 0,24 | 2,85 |
| | | | | | | | | | | | | | | | | | | |
| Comparative grade | | 0,148 | 0,257 | 1,806 | 0,014 | 0,002 | 0,0050 | 0,040 | 0,365 | 0,005 | 0,003 | 0,007 | 0,015 | 0,0000 | 0,56 | 0,35 | 0,27 | 2,43 |

FIG. 3

| Test values In longitudinal direction | Hot strip in 2.00 mm Variant A (910/710°C) | | Hot strip in 2.30 mm Variant B (910/500°C) | | Cold strip in 1.00 mm Variant A (910/710°C) 2 | | Cold strip in 2.00 mm Variant B (910/500°C) | |
|---|---|---|---|---|---|---|---|---|
| | method 2 | method 3 | method 2 | method 3 | method | method 3 | method 2 | method 3 |
| Rp0.2 in MPa | 580 | 661 | 565 | 661 | 442 | 520 | 461 | 611 |
| Rm in MPa | 844 | 908 | 830 | 905 | 793 | 780 | 821 | 847 |
| A80 in % | 10.9 | 10.1 | 10.7 | 10.6 | 14.5 | 14.2 | 15.4 | 10.2 |
| LAW in % (According to ISO 16630) | 45 | 77 | 41 | 54 | 48 | 67 | 36 | 41 |
| BH2 in MPa | 47 | 51 | 53 | 49 | 51 | 46 | 48 | 52 |
| Rp0.2/Rm * 100% | 69 | 73 | 68 | 73 | 56 | 67 | 56 | 72 |
| Achievable steel grade | x) | 3) | x) | 3) | 1) | 1) | 1) | 2) |
| Steel grades according to VDA 239-100: 1) CR440Y780T-DP 2) CR570Y780T-CP 3) HR660Y60T-CP x) normatively not assignable | | | | | | | | |

FIG. 4

| Steel | Variant / Method | Thickness | Hole expansion ratio Relative to comparative grade | Hole expansion ratio According to ISO 16630 |
|---|---|---|---|---|
| Comparative grade | A, 2 | 1.00 mm | 100% | 25% |
| | A, 3 | 1.00 mm | 100% | 30% |
| Invention | A, 2 | 1.00 mm | 180% | 45% |
| | A, 3 | 1.00 mm | 257% | 77% |
| Comparative grade | B, 2 | 2.00 mm | 100% | 21% |
| | B, 3 | 2.00 mm | 100% | 31% |
| Invention | B, 2 | 2.00 mm | 171% | 36% |
| | B, 3 | 2.00 mm | 132% | 41% |
| Note: average value of at least 4 tests, punched holes $D_0$=10 mm | | | | |

FIG. 5

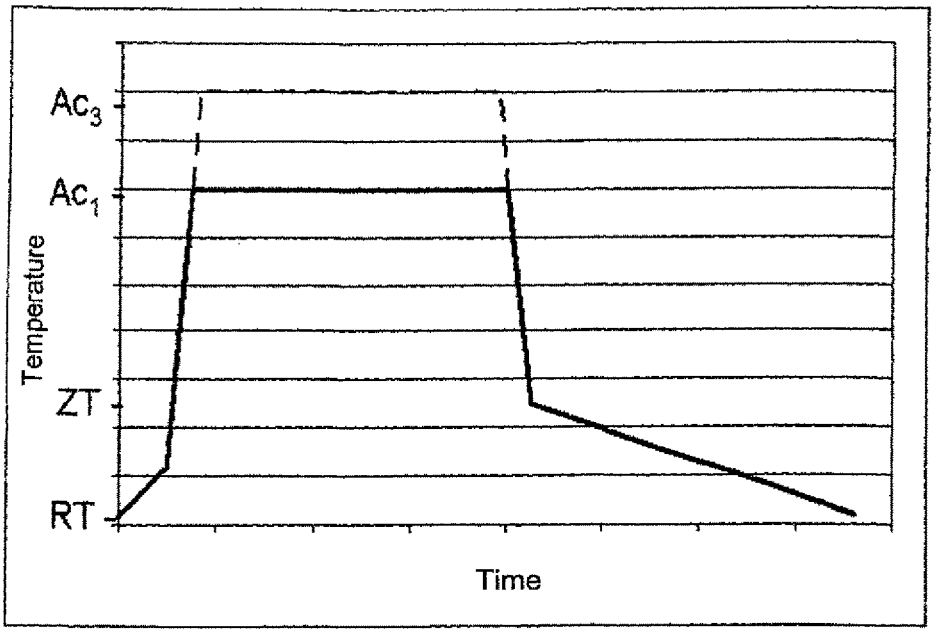
Figure 6a: Method 1, (Legend ZT = intermediate temperature, RT = room temperature)
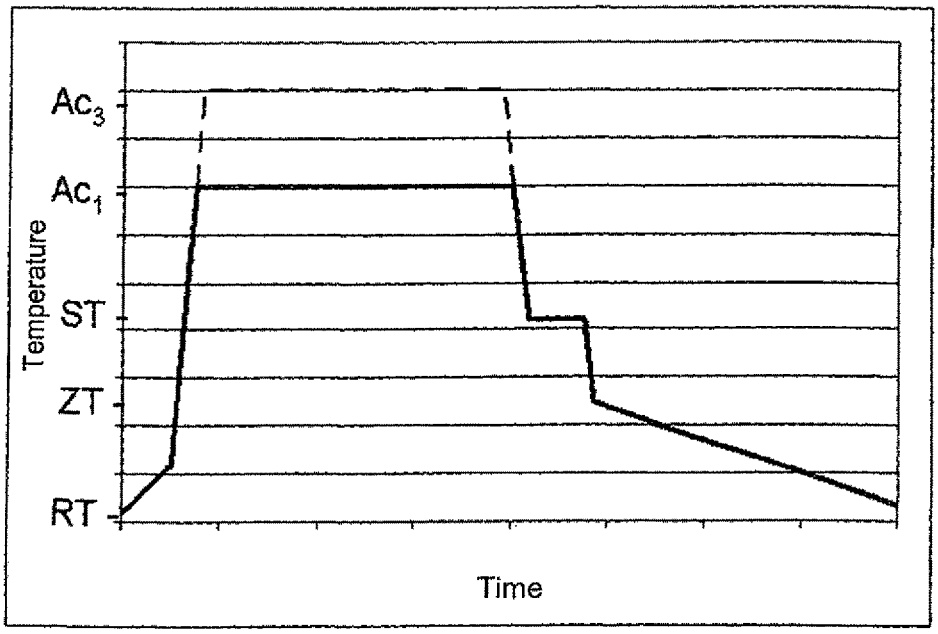
Figure 6b: Method 2, (Legend ST = hot dip bath temperature, ZT = intermediate temperature RT = room temperature

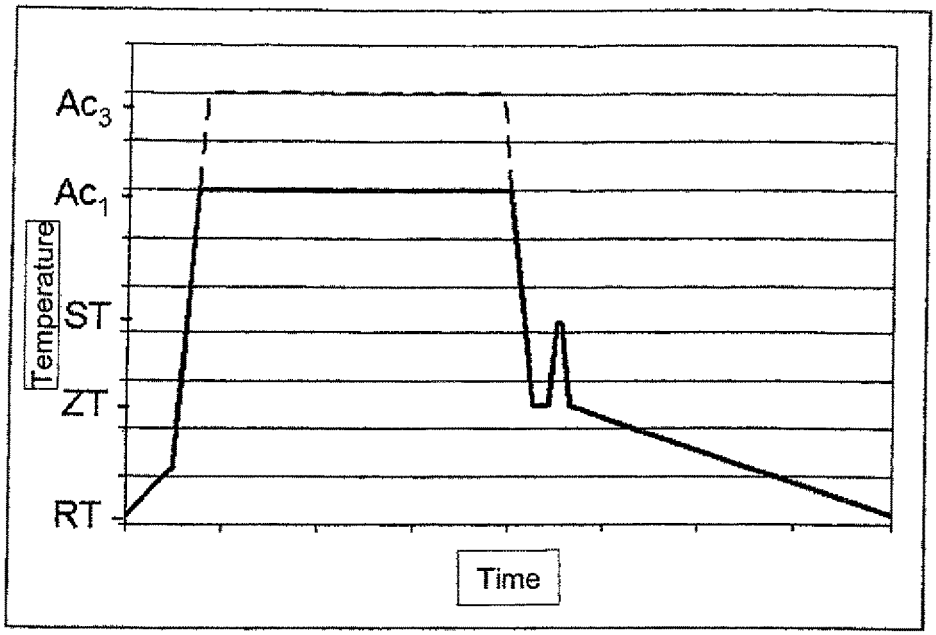
Figure 6c: method 3, (Legend ST = hot dip bath temperature, ZT = intermediate temperature, RT = room temperature

MICRO-ALLOYED HIGH-STRENGTH MULTI-PHASE STEEL CONTAINING SILICON AND HAVING A MINIMUM TENSILE STRENGTH OF 750 MPA AND IMPROVED PROPERTIES AND METHOD FOR PRODUCING A STRIP FROM SAID STEEL

CROSS-REFERENCES TO RELATED APPLICATIONS

This application is a divisional of prior filed copending U.S. application Ser. No. 14/908,471, filed Jan. 28, 2016, the priority of which is hereby claimed under 35 U.S.C. § 120, and which is the U.S. National Stage of International Application No. PCT/DE2014/000295, filed May 27, 2014, which designated the United States and has been published as International Publication No. WO 2015/014333 and which claims the priority of German Patent Application, Serial No. 10 2013 013 067.0, filed Jul. 30, 2013, pursuant to 35 U.S.C. 119(a)-(d).

The contents of U.S. application Ser. No. 14/908,471, International Publication No. WO 2015/014333, and German Patent Application No. 10 2013 013 067.0, are incorporated herein by reference in their entireties as if fully set forth herein.

BACKGROUND OF THE INVENTION

The invention relates to a high-strength multi-phase steel.

The invention also relates to a method for producing a hot and/or cold rolled strip made of such a steel.

The invention relates in particular to steels with a tensile strength in the range of at least 750 MPa up to maximally 920 MPa with low yield to tensile ratios of maximally 73% for producing components, which have an excellent formability and improved welding properties, such as the failure of the welding seam.

The hotly contested market forces automobile manufacturers to constantly seek solutions for lowering fleet consumption, while retaining a highest possible comfort and vehicle occupant protection. In this context an important factor is on one hand to save weight in all vehicle components, however, on the other hand also a favorable behavior of the individual components when subjected to high static and dynamic stress during operation or in the case of a crash. Pre-material suppliers seek to address this requirement by providing high-strength and ultra-high-strength steels with thin sheet thickness to reduce the weight of the vehicle components while at the same time improving forming and component properties during manufacture and during use.

High-strength and ultra-high-strength steels enable lighter vehicle components, which leads to reduced fuel consumption and reduced pollution due to the reduced $CO_2$ proportion.

These steels therefore have to meet relatively high demands regarding their strength and ductility, energy absorption capacity and during their processing, such as for example during pickling, hot or cold forming, welding and/or metallic coating (organic coating or varnishing).

Newly developed steels thus must met the demands placed on weight reduction, the increasing material demands on ultimate yield strength, strain hardening behavior and elongation at fracture while still being well formable, as well as the demands placed on the component of high tenacity, border crack resistance, energy absorption and strength and the bake hardening effect, but also improved suitability for joining in the form of e.g. improved weldability, such as improved failure behavior of the welding seam (fracture pattern).

Improved edge crack resistance means increased hole expansion capacity during forming and is also known as low edge crack (LEC) or high hole expansion (HHE).

Improved weldability is achieved inter alia by a lowered carbon equivalent. Synonymous terms for this are underperitectic (UP) or the already known low carbon equivalent (LCE).

An improved failure behavior of the welding seam (fracture pattern) is achieved inter alia by the addition of micro-alloying elements.

The steel according to the invention also has the goal to selectively reduce the thickness of particular components made of micro-alloyed ferritic steels already used in automobile manufacturing in order to save weight.

Such a reduction of the thickness of the steel sheet thus requires a high-strength steel with single or multiphase microstructure in order to ensure sufficient strength of the motor vehicle components.

In vehicle construction dual phase steels are increasingly used, which consist of a ferritic basic structure in which a martensitic second phase is integrated. It has been shown that in low-carbon, micro-alloyed steels proportions of further phases such as bainite and residual austenite have an advantageous effect on the hole expansion behavior. Bainite can hereby be present in different manifestations.

The specific material properties of the dual-phase steels, such as for example a low yield-to-tensile ratio at very high tensile strength, strong strain hardening and good cold formability, are well known.

Generally the group of multi-phase steels is increasingly used, which include for example complex-phase steels, ferritic-bainitic steels, TRIP steels as wells as the above-described dual-phase steels, which are characterized by different microstructure compositions.

Complex-phase steels are according to EN 10346 steels that contain small proportions of martensite, residual austenite and/or perlite in a ferritic/bainitic basic structure, wherein a delayed re-crystallization or precipitations of micro-alloy elements cause a strong grain refinement.

Compared to dual-phase steels these complex-phase steels have higher yield strengths, a higher yield-to-tensile ratio, lower strain hardening and higher hole expansion capacity.

Ferritic-bainitic steels are according to EN 10346 steels, which contain bainite or strain-hardened bainite in a matrix of ferrite and/or strain hardened ferrite. The strength of the matrix is caused by a high dislocation density, by grain refinement and by the precipitation of micro-alloy elements.

Dual-phase steels are according to EN 10346 steels with a ferritic basic microstructure in which a martensitic second phase is incorporated island like, possibly also with proportions of bainite as second phase. Dual-phase steels possess high tensile strength while exhibiting a low yield-to-tensile ratio and strong strain hardening.

TRIP-steels are according to EN 10346 steels with a predominantly ferritic basic microstructure in which residual austenite is incorporated, which can transform into martensite during forming (TRIP effect). Due to its strong strain hardening the steel has very good uniform elongation characteristics and high tensile strength.

In connection with the Bake-Hardening effect, high component strengths can be achieved. These steels are suited for stretch forming and also for deep drawing. In the forming of the material however higher sheet holding forces and press forces are required. A relatively strong spring-back has to be taken into account.

The high-strength steels with single-phase microstructure also include for example bainitic and martensitic steels.

Bainitic steels are according to EN 10346 steels that are characterized by a very high yield strength and tensile strength at a sufficiently high expansion for cold forming processes. The chemical composition results in a good weldability. The microstructure typically consists of bainite. In some cases small proportions of other phases such as martensite and ferrite can be contained.

Martensitic steels are according to EN 10346 steels that as a result of thermo mechanical rolling contain small proportions of ferrite and/or bainite in a basic structure of martensite. This steel type is characterized by a very high yield strength and tensile strength at sufficiently high elongation for cold forming processes. Within the group of multi-phase steels the martenisititc steels have the highest tensile strength values.

The suitability for deep drawing is limited. The martensitic steels are predominantly suited for forming processes that involve bending, such as roll forming.

High-strength steels are used in structural components, chassis components and crash-relevant components as steel plates, Tailored Blanks (welded steel plates) as well as flexibly cold tolled strips, so called TRB®s.

The Tailor Rolled Blank lightweight construction technology (TRB®) enables a significant weight reduction as a result of the load-adjusted selection of sheet thickness over the length of the component or steel type.

In the continuous annealing facility, a special heat treatment is performed for setting a defined microstructure in which the steel is provided with its low yield strength by relatively soft components such as ferrite or bainitic ferrite and obtains its strength by its hard components such as martensite or carbon-rich bainite.

For economic reasons cold-rolled high-strength to ultra-high strength steel strips are usually subjected to recrystallizing annealing in the continuous annealing process to generate well formable steel sheet. Depending on the alloy composition and the strip cross section, the process parameters such as throughput speed, annealing temperature and cooling rate (cooling profiles), are adjusted corresponding to the demanded mechanical-technological properties by way of the microstructure required therefore.

For establishing a dual-phase microstructure, the pickled hot strip in typical thicknesses between 1.50 mm to 4.00 mm, or cold strip in typical thicknesses of 0.50 mm to 3.00 mm, is heated in the continuous annealing furnace to such a temperature that the required microstructure forms during the cooling. The same applies for configuring a steel with complex-phase microstructure, martensitic, ferritic-bainitic and also purely bainitic microstructure.

Especially in the case of different thicknesses in the transition region of one strip to another, a constant temperature is difficult to achieve. When annealing alloy compositions with too narrow process windows this can lead to the fact that for example the thinner strip is either moved through the furnace too slowly, thereby lowering productivity, or that the thicker strip is moved through the furnace too fast and the required annealing temperatures and cooling gradients for achieving the desired microstructure are not reached. This results in increased waste.

Widened process windows are necessary in order to enable the demanded strip properties at same process parameters also in the case of greater differences in cross section of the strips to be annealed.

The problem of a too narrow process window is especially pronounced in the annealing treatment when stress-optimized components made of hot or cold strip are to be produced, which have sheet thicknesses that vary across the strip length and strip width (for example as a result of flexible rolling).

However, when strongly varying sheet thicknesses are involved, production of TRB®s with multi-phase microstructure employing the presently known alloys and available continuous annealing systems requires increased costs, for example an additional heat treatment prior to the cold rolling. In regions of different sheet thickness, i.e., in case of varying degrees of rolling reduction, a homogenous multi-phase microstructure cannot be established in cold-rolled and hot-rolled steel strips due to the temperature difference in the conventional alloy specific narrow process windows.

A method for producing a steel strip with different thickness across the strip length is for example described in DE 100 37 867 A1.

When high demands on corrosion protection require the surface of the hot or cold strip to be hot dip galvanized, the annealing is usually carried out in a continuous annealing furnace arranged upstream of the hot dip galvanizing bath.

Also in the case of hot strip, depending on the alloy concept, the demanded microstructure is not established until the annealing in the continuous furnace, in order to realize the demanded mechanical properties.

Deciding process parameters are thus the adjustment of the annealing temperatures and the speed as well as the cooling rate (cooling gradient) in the continuous annealing because the phase transformation is temperature and time dependent. Thus, the less sensitive the steel is regarding the uniformity of the mechanical properties when the temperature and time course changes during the continuous annealing, the greater is the process window.

When utilizing the known alloy concept for a multiphase steel in the continuous annealing of hot and cold rolled steel strips of different thickness, the problem arises that although the alloy composition tested there satisfies the demanded mechanical properties, only a narrow process window is available for the annealing parameters to enable establishment of uniform mechanical properties across the strip length without having to adjust the process parameters.

When using the known alloy concepts for the group of multi-phase steels, the narrow process window makes it already difficult during the continuous annealing of strips with different thicknesses to establish uniform mechanical properties over the entire length and width of the strip.

In the case of flexibly rolled cold strip made of multi-phase steels of known compositions, the too narrow process window either causes the regions with lower sheet thickness to have excessive strengths resulting from excessive martensite proportions due to the transformation processes during the cooling, or the regions with greater sheet thickness achieve insufficient strengths as a result of insufficient martensite proportions. Homogenous mechanical-technological properties across the strip length or width can practically not be achieved with the known alloy concepts in the continuous annealing.

The goal to achieve the resulting mechanical-technological properties in a narrow region across the strip width and strip length through controlled adjustment of the volume proportions of the microstructure phases has highest priority and is therefore only possible through a widened process window. The known alloy concepts for multiphase steels are characterized by a too narrow process window and are therefore not suited for solving the present problem, in particular in the case of flexibly rolled strips. With the alloy concepts known to date only steels of one strength class with defined cross sectional regions (sheet thickness and strip width) can be produced, hence requiring different alloy concepts for different strength classes or cross sectional ranges.

The state of the art is to increase the strength by increasing the amount of carbon and/or silicone and/or manganese (solid solution hardening) and to increase strength via the microstructure adjustments at adjusted temperature profile.

However, increasing the amounts of the aforementioned elements increasingly worsens the material processing properties for example during welding, forming and hot dip coating, but also the industrial production in all process steps such as steel production, hot rolling picking, cold rolling and heat treatment with/without hot dip coating places increased demands on the individual facilities.

In the steel production there is a trend toward reducing the carbon equivalent in order to achieve an improved cold processing and better properties during use.

For describing and quantifying the strip processing, in particular the edge crack behavior, the hole expansion test according to ISO 16630 is used as one of multiple possible testing methods.

But also suitability for welding, characterized by the carbon equivalent has become an increased focus.

For example in the following carbon equivalents $$CEV=C+Mn/6+(Cu+Ni)/15+(Cr+Mo+V)/5$$

$$CET=C+(Mn+Mo)/10+(Cr+Cu)/20+Ni/40$$

$$PCM=C+(Mn+Cu+Cr)/20+Ni/60+Mo/15/+/V10+5B$$

the characteristic standard elements such as carbon and manganese as well as Chromium or Molybdenum and Vanadium are taken into account.

Silicone plays a minor role for calculating the carbon equivalent. This is of deciding importance with regard to the invention. The lowering of the carbon equivalent through lower contents of carbon and manganese is to be compensated by increasing the silicone content. Thus the edge crack resistance and welding suitability are improved at same strengths.

A low yield-tensile ratio (Re/Rm) of below 65 is typical for a dual-phase steel and serves in particular for the formability in stretching and deep drawing processes. This provides the constructor with information regarding the distance between ensuing plastic deformation and failing of the material at quasi-static load. Correspondingly lower yield strength ratios represent a greater safety margin for component failure.

A higher yield to tensile ratio (Re/Rm) of over 65, as it is typical for complex-phase steels, is also characterized by a resistance against edge cracks. This can be attributed to the smaller differences in the strengths of the individual microstructure components, which has a positive effect on a homogenous deformation in the region of the cutting edge.

With regard to the yield strength the norms provide for an overlap region within which an attribution to complex-steels as well as dual-phase steels is possible.

The analytical landscape for achieving multi-phase steels with minimal strengths of 750 MPa is very diverse and reveals very broad alloy ranges regarding the strength-promoting elements carbon, silicone, manganese, phosphorous, aluminum and also chromium and/or molybdenum as well as regarding the addition of micro-alloys such as titanium niobium, vanadium and/or boron and regarding the material-characterizing properties.

The spectrum of dimensions is broad and lies in the thickness range of 0.50 to 4.00 mm. Predominantly strips of up to about 1850 mm are used but also slit strip dimensions, which are generated by longitudinally separating the strips. Sheets or plates are generated by transverse separation of the strips.

SUMMARY OF THE INVENTION

The invention is therefore based on the object to set forth a new alloy concept for a high-strength, multi-phase steel with a minimal tensile strength of 750 to 920 MPa longitudinally and transversely to the rolling direction, preferably with dual-phase microstructure and a yield strength ratio of at most 73% with which the process window for the continuous annealing of hot and cold rolled strips can be widened so that beside strips with different cross sections also steel strips with thicknesses that vary over the strip length or strip width and the correspondingly varying cold rolling reduction degrees can be generated with mechanical technological properties that are as homogenous as possible. In addition a hot dip coating (hot dip galvanizing capacity) of the steel is to be ensured and a method for producing a strip made of this steel is provided.

According to the teaching of the invention this object is solved by a steel with the following contents in weight %:

C≥0.075to ≤0.105
Si≥0.600 to ≤0.800
Mn≥1.000 to ≤0.700
Cr≥0.100 to ≤0.480
Al≥0.010 to ≤0.060
N 0.0020≤0.0120
S≤0.0030
Nb≥0.005 to ≤0.050
Ti≥0.0050 to ≤0.050
B≥0.0005 to ≤0.0040
Mo≤0.200
Cu≤0.040%
Ni≤0.040% remainder iron including usual steel accompanying elements not mentioned above.

The steel according to the invention is very well suited for hot dip galvanizing and has a significantly widened process window compared to the known steels. This results in an increased process reliability during continuous annealing of cold and hot strip with dual-phase or multi-phase microstructure. Thus more homogenous mechanical-technological properties can be ensured in the strip for continuously annealed hot or cold strips also in the case of different cross sections and otherwise same process parameters.

This applies for the continuous annealing of consecutive strips with different strip cross sections as wells as for strips with a thickness that varies over the strip length or strip width. This enables for example processing within selected thickness ranges (such as a strip thickness of smaller than 1 mm, a strip thickness of 1 to 2 mm and a strip thickness of 2 to 4 mm).

When high-strength, hot strips or cold strips made of multi-phase steel with varying sheet thicknesses are produced according to the invention in the continuous annealing method, stress-optimized components can advantageously be produced from this material by forming.

The produced material can be produced as cold strip and also as hot strip via a hot dip galvanizing line or a pure continuous annealing line in the skin passed or non skin passed state and also in the heat treated state (intermediate annealing).

With the alloy composition according to the invention steel strips can be produced by an inter-critical annealing between $A_{c1}$ and $A_{c3}$ or an austenitic annealing above $A_{c3}$ with final controlled cooling, which leads to a dual-phase or multi-phase microstructure.

Annealing temperatures of 700 to 950° C. have proven advantageous. Depending on the overall process there are different approaches for realizing the heat treatment.

In a continuous annealing facility without subsequent hot dip coating, the strip is cooled starting from the annealing temperature to an intermediate temperature of about 160 to 250° C. with a cooling rate of about 15 to 100° C./s. Optimally, cooling to a prior intermediate temperature of 300 to 500° C. can be conducted beforehand with a cooling rate of 15 to 100° C./s. Finally cooling to room temperature occurs with a cooling rate of about 2 to 30° C. (Variant 1 FIG. 6*a*).

In a heat treatment within the framework of a hot dip coating, two temperature profiles are possible. The cooling as described above is halted prior to entry into the dip bath and is only continued after emergence from the bath until reaching the intermediate temperature of about 200 to 250° C. Depending on the dip bath temperature, a holding temperature of about 400 to 470° C. results in this case. The cooling to room temperature occurs again with a cooling rate of 2 to 30° C./s. (Variant 2, FIG. 6*b*).

The second variant of the temperature profile in the case of hot dip coating includes holding the temperature for about 1 to 20s at the intermediate temperature of 200 to 350° C. and subsequent reheating to the temperature of 400 to 470° C. required for the hot dip coating. After the hot dip coating the strip is cooled again to 200 to 250° C. The cooling to room temperature is conducted again with a cooling rate of 2 to 30° C./s. (Variant 3, FIG. 6*c*).

Beside carbon, also manganese, chromium and silicone, are responsible for the transformation of austenite to martensite in classical dual-phase steels. Only the combination according to the invention of the added elements carbon, silicone, manganese and chromium ensures on one hand the demanded mechanical properties of minimal tensile strengths of 750 MPa and yield strength ratios of below 73% at simultaneous significantly widened process window in the continuous annealing.

Tests have shown that in particular the addition of silicone in amounts of 0.600-0.800% enables a wide process window for a great range of dimensions and is suited to achieve the demanded tensile strength of at least 750 MPa for hot strip and at least 780 MPa for cold rerolled hot strip and cold strip.

A characteristic of the material is also that addition of manganese at increasing mass percentages shifts the ferrite region to longer times and lower temperatures during cooling. The proportions of ferrite are hereby also reduced by increased proportions of bainite depending on the process parameters.

Setting a low carbon content of ≤0.105% enables reducing the carbon equivalent, which improves weldability and avoids excessive hardening. In addition the service life of the electrode in the resistance spot welding can be significantly increased.

In the following the effect of the elements in the alloy according to the invention is described in more detail. The multiphase steels typically have a chemical composition in which alloy components are combined with and without micro-alloying elements. Accompanying elements are unavoidable and are taken into account regarding their effect when necessary.

Accompanying elements are elements, which are already present in the iron ore or enter the steel due to manufacturing. Due to their predominantly negative effect they are usually undesired. It is sought to remove them so as to reach a tolerable content or to convert them into less deleterious forms.

Hydrogen (H) is the only element capable of diffusing through the iron lattice without generating lattice tensions. As a result hydrogen is relatively mobile in the iron lattice and can be taken up relatively easily during manufacturing. Hydrogen can thereby only be taken up into the iron lattice in atomic (ionic) form.

Hydrogen has a strong embrittling effect and diffuses preferably to energetically favorable sites (defects, grain boundaries etc.). The defects act as hydrogen traps and can significantly increase the retention time of the hydrogen in the material.

The recombination to molecular hydrogen can lead to cold cracks. This behavior occurs in the hydrogen embrittlement or in hydrogen-induced stress corrosion. Hydrogen is also often named as the cause for the so-called delayed fracture, which occurs without external tensions.

A more uniform microstructure, which is achieved with the steel according to the invention inter alia by virtue of its widened process window, lowers the sensitivity against hydrogen embrittlement.

Therefore the hydrogen content in the steel should be as low as possible.

Oxygen (O): in the molten state, steel has a relatively high capacity for absorbing gases, however, at room temperature oxygen is only soluble in very low amounts. Analogous to hydrogen, oxygen can only diffuse into the material in atomic form. Due to the strongly embrittling effect and the negative effect on the ageing resistance, oxygen content is sought to be reduced during production as much as possible.

For reducing the amount of oxygen, on one hand production methods such as a vacuum treatment, and on the other hand analytical approaches exist. Oxygen can be converted into harmless states by adding certain alloy elements. For example it is common to bind oxygen via manganese, silicone and/or aluminum. However, the oxides produced thereby can cause negative properties in the material in the form of defects.

For the above-stated reasons the oxygen content in the steel should be as low as possible.

Phosphorous (P) is a trace element contained in the iron ore and is solubilized in the iron lattice as substitution atom. As a result of the solid solution strengthening phosphorous increases strength and improves hardenability, However, it is usually sought to lower the phosphorous content as far as possible because inter alia due to its slow diffusion speed it has a strong tendency to segregation and strongly lowers tenacity. Deposition of phosphorus at the grain boundaries can lead to grain boundary cracks. In addition phosphorous increases the transition temperature from tenacious to brittle behavior by up to 300° C. During hot rolling, surface-proximate phosphorous oxides can lead to separation at the grain boundaries.

However, due to the low costs and the high strength increase, phosphorous is used in some steels in low amounts (<0.1%) as micro-alloying element for example in high strength IF-steels (interstitial free), bake hardening steels or also in some alloying concepts for dual-phase steels. The steel according to the invention differs from known analysis concepts that use phosphorous as a solid solution former (for example EP 2 412 842 A1 or EP 2 128 295 A1) inter alia in that phosphorous is not added.

For the aforementioned reasons phosphorous is limited to unavoidable amounts during steel production.

Sulfur (S), like phosphorous is bound as trace element in the iron ore. It is undesired in the steel (exception automate steels) because of its strong tendency for segregation and strong embrittling effect. It is therefore sought to achieve as low amounts of sulfur as possible in the melt (for example by a deep vacuum treatment). Further the present sulfur is converted into the relatively harmless compound manganese sulfide (MnS) by adding manganese.

The manganese sulfides are often rolled out band-like during rolling and function as germination sites for the transformation. Especially in the case of diffusion-controlled transformation this leads to a microstructure that is configured band-like and can lead to impaired mechanical properties in the case of strongly pronounced banding (for example pronounced martensite bands instead of distributed martensite islands, anisotropic material behavior, reduced elongation at brake).

For the foregoing reasons the sulfur content is limited to ≤0.0030%, advantageously to ≤0.0020% or optimally to ≤0.0010% or to unavoidable amounts during steel production.

Alloying elements are usually added to the steel in order to influence properties in a targeted manner. An alloying element can influence different properties in different steels. The effect generally depends strongly on the amount and the solubility state in the material.

The interrelations can thus be very diverse and complex. In the following the effect of the alloying elements is described in more detail.

Carbon (C) counts as the most important alloy element in the steel. Its targeted introduction to up to 2.06% turns iron into steel in the first place. Oftentimes the carbon content is drastically lowered during steel production. In dual-phase steels for a continuous hot dip coating its content is maximally 0.230% according to EN 10346 or VDA 239-100, a minimal value is not given.

Due to its relatively small atomic radius carbon is dissolved interstitially in the iron lattice. The solubility in the a-iron is maximally 0.02% and in the y-iron maximally 2.06%. In solubilized form carbon significantly increases the hardenability of steel and is thus indispensible for the formation of sufficient amounts of martensite. Excessive carbon contents, however, increase the hardness difference between ferrite and martensite and limit weldability.

In order to satisfy the demands on a high hole expansion, the steel according to the invention contains less than 0.105% carbon.

As a result of the different solubility, pronounced diffusion processes are necessary in the phase transformation, which can lead to very different kinetic conditions. In addition carbon increases the thermodynamic stability of the austenite, which becomes apparent in the phase diagram as a widening of the austenite region toward lower temperatures. With increasing force-solubilized carbon content in the martensite, the lattice distortions increase and associated with this the strength of the non-diffusively generated phase.

In addition carbon forms carbides. A representative, which is present in almost every steel is cementite ($Fe_3C$). However, significantly harder special carbides can form with other metals such as chromium, titanium, niobium and vanadium. Hereby not only the type but also the distribution and size of the precipitations is of deciding importance for the resulting strength increase. In order to ensure a sufficient strength on one hand and a good weldability on the other hand, the minimal C-content is set to 0.075% and the maximal C-content to 0.105%.

Silicone (Si) binds oxygen during casting and is thus used for deoxidizing the steel. Important for the later steel properties is that he segregation coefficient is significantly lower than that of for example manganese (0.16 compared to 0.87). Segregations generally lead to a banded arrangement of the microstructure components, which impair the forming properties, for example the hole expansion.

Depending on the material the addition of silicone results in a strong solid solution hardening. The addition of 0.1% silicone results in an approximate increase of the tensile strength by about 10 MPa, wherein up to 2.2% silicone only impairs expansion insignificantly. In this context different sheet thicknesses and annealing temperatures where observed. The increase from 0.2% to 0.6% silicone resulted in a strength increase of about 20 MPa in yield strength and about 70 MPa in tensile strength. The elongation at break hereby decreases by only about 2%. The latter results inter alia from the fact that silicone lowers the solubility of carbon in ferrite, which causes the ferrite to be softer, which in turn improves formability. In addition silicone prevents the formation of carbides, which lower ductility as brittle phases. The low strength increasing effect of silicone within the range of the steel according to the invention forms the basis of a wide process window.

A further important effect is that silicone shifts the formation of ferrite toward shorter times and thus enables generation of sufficient amounts of ferrite prior to quenching. During hot rolling this creates a basis for an improved cold rollability. As a result of the accelerated ferrite formation the austenite is enriched with carbon during hot dip galvanizing and thus stabilized. Because silicone inhibits carbide formation, the austenite is additionally stabilized. Thus the formation of bainite can be suppressed in the accelerated cooling in favor of martensite.

According to the patent claims further particular properties of silicone are noted. The above-described delay of carbide formation could also for example be caused by aluminum. However, aluminum forms stable nitrides, so that no sufficient amounts of nitrogen are available for the formation of carbonitrides with micro-alloying elements. Alloying with silicone eliminates this problem because silicone neither forms carbides nor nitrides. Thus silicone has an indirect positive effect on the formation of precipitations by micro-alloying, which in turn have a positive effect on the strength of the material. Because the increase of the transformation temperatures by silicone tends to favor grain refinement, micro-alloying with niobium, titanium and boron is particularly advantageous.

As is known, in steels with higher silicone alloyed steels strongly adhering red scale is supposed to form and a higher risk of rolled-in scale arises during hot rolling which can have an influence on the subsequent pickling result and the pickling productivity. This effect could not be detected in the steel according to the invention with 0.600% to 0.800% silicone when the pickling was advantageously performed with hydrochloric acid instead with sulfuric acid.

With regard to the galvanization capacity of silicone-containing steels, DE 196 10 675 C1 describes inter alia that steels with up to 0.800% silicone or up to 2.000% silicone cannot be hot dip galvanized due to the very poor wettability of the steel surface with the liquid zinc.

Beside the recrystallization of the full hard strip, the atmospheric conditions in a continuous hot dip galvanizing facility during the annealing treatment cause a reduction of iron oxide, which may form on the surface for example during cold rolling or as a result of storage at room temperature. However, for oxygen-affine alloy components, such as silicone, manganese, chromium, boron the overall atmosphere is oxidizing, which may result in segregation and selective oxidation of these elements. The selective oxidation can occur externally, i.e., on the substrate surface as well as internally in the metallic matrix.

It is known that during annealing in particular silicone can diffuse to the surface and by itself or together with manganese form film-like oxides. These oxides can prevent contact between the substrate and the melt and prevent or significantly impair the wetting reaction. As a result un-galvanized sites, so-called "bare spots" or even large-surface regions without coating can occur. Further the impaired wetting reaction may result in insufficient formation of an inhibition layer and thus decrease the adhesion of the zinc or zinc alloy layer on the substrate. The above-mentioned mechanisms also apply to a pickled hot strip or cold rolled hot strip.

In contrast to this general knowledge in the state of the art, tests have unexpectedly shown that solely by suitably operating the furnace during recrystallizing annealing and during passage through the Zinc bath a good galvanizabiltiy of the steel strip and a good Zinc adhesion can be achieved.

For this the strip surface first has to be freed of scale remnants, rolling oil or other dirt particles by a chemical or thermal-hydro-mechanical pre-cleaning. In order to prevent silicone oxides from reaching the surface, measures also have to be taken to promote the inner oxidation of the alloy elements below the surface of the material. Depending on the configuration of the facility, different measures are used for this purpose.

In a facility configuration in which the annealing process step is performed exclusively with a radiant tube furnace (RTF) (see method 3 in FIG. 6*c*), the inner oxidation of the alloy elements can be influenced in a targeted manner by adjusting the oxygen partial pressure of the furnace atmosphere ($N_2$-$H_2$ protective gas atmosphere). The adjusted oxygen partial pressure hereby has to satisfy the following equation, wherein the furnace temperature is between 700 and 950° C.

$$-12>\text{Log } pO_2 \geq 5*Si^{-0.25}-3*Mn^{-0.5}-0.1*Cr^{-0.5}-7*(-InB)^{0.5}.$$

Hereby Si, Mn, Cr, B designate the corresponding alloy proportions in the steel in mass % and $pO_2$ the oxygen partial pressure in mbar.

In a configuration of a facility in which the furnace region consists of a combination of a direct fired furnace (DFF or non-oxidizing furnace NOF) and a subsequent radiant tube furnace (see method 2 in FIG. 6*b*) the selective oxidation can also be influenced via the gas atmosphere of the furnace regions.

Via the combustion reaction in the NOF the oxygen partial pressure and with this the oxidation potential for iron and the alloy components can be adjusted. The oxidation potential is to be adjusted so that the oxidation of the alloy elements occurs internally, below the steel surface and a thin iron oxide layer may form on the steel surface after passage through the NOF region. This is achieved for example via reducing the CO-value below 4%.

In the subsequent radiant tube furnace the iron oxide layer, which may have formed and also the alloy elements are further reduced under $N_2$-$H_2$ protective gas atmosphere. The adjusted oxygen partial pressure in this furnace region hereby has to satisfy the following equation, wherein the furnace temperature is between 700 and 950° C.

Hereby Si, Mn, Cr, B designate the corresponding alloy proportions in the steel in mass % and $pO_2$ the oxygen partial pressure in mbar.

$$-18>\text{Log } pO_2 \geq 5*Si^{-0.3}-2,2*Mn^{-0.45}-0.1*Cr^{-0.4}-12.5*(-InB)^{0.25}$$

In the transition region between furnace→zinc pot (tuyere snout) the dew point of the gas atmosphere ($N_2$-$H_2$ protective gas atmosphere) and with this the oxygen partial pressure is to be adjusted so that oxidation of the strip is avoided prior to immersion into the melt bath. Dew points in the range of from −30 to −40° C. have proven advantageous.

The above-described measures in the furnace region of the continuous hot dip galvanizing plant prevent the surface formation of oxides and achieve a uniform good wettability of the strip surface with the liquid melt.

When instead of the hot dip galvanizing the method route of the continuous annealing with subsequent electrolytic galvanizing is selected (see method 1 in FIG. 6*a*), no special measures are required to ensure galvanizability. It is known that galvanizing of higher-alloyed steels can be significantly easier realized by electrolyte galvanizing than by continuous hot dip galvanizing. In electrolytic galvanizing, pure zinc is deposited directly on the strip surface. In order to not impair the electron flow between the steel strip and the zinc-ions and with this the galvanization, it has to be ensured that no surface-covering oxide layer is present on the strip surface. This condition is usually ensured by a standard reducing atmosphere during the annealing and a pre-cleaning prior to electrolysis.

In order to ensure process window during the annealing that is as wide as possible and a sufficient galvanizing capacity the minimal Si-content is set to 0.600% and the maximal silicone content to 0.800%.

Manganese (Mn) is added to almost every steel for de-sulfurization in order to convert the deleterious sulfur into manganese sulfides. In addition, as a result of solid solution strengthening, manganese increases the strength of the ferrite and shifts the α-/γ-transformation toward lower temperatures.

A main reason for adding manganese in dual-phase steel is the significant improvement of the hardness penetration. Due to the diffusion impairment the perlite and bainite transformation is shifted toward longer times and the martensite start temperature is lowered.

At the same time, however, addition of manganese increases the hardness ratio between martensite and ferrite. In addition the banding of the microstructure is increased. A high hardness difference between the phases and the formation of martensite bands results in a lower hole expansion capacity, which has an adverse affect on edge crack resistance.

Like silicone, manganese tends to form oxides on the steel surface during the annealing treatment. Depending on the annealing parameters and the content of other alloy elements (in particular silicone and aluminum), manganese oxides (for example MnO) and/or Mn mixed oxides (for example $Mn_2SiO_4$) may form. However, manganese is less critical at a low Si/Mn or Al/Mn ratio because globular oxides instead of oxide films form. Nevertheless high manganese contents may negatively influence the appearance of the zinc layer and the zinc adhesion.

For the stated reasons the Mn-content is set to 1.000 to 1.900%.

For achieving the demanded minimal strengths, it is advantageous to vary the manganese content in dependence on the cross section. For a strip thickness range of <1.00 mm the Manganese content is preferably ≤1.500%, at strip thicknesses of 1.00 to 2.00 mm at ≤1.750%, and at strip thicknesses of >2.00 mm at ≤1.500%.

A further particular aspect of the invention is that the variation of the manganese content can be compensated by simultaneous change of the silicone content. The strength increase (yield strength, YS) by manganese and silicone is generally well described by the following Pickering equation:

$$YS(\text{MPa})=53.9+32.34[\%\ \text{Mn}]+83.16[\%\ \text{Si}]+354.2[\%\ \text{Ni}]+17.402d^{(-1/2)}$$

This equation, however, is predominantly based on the effect of the solid solution hardening, which according to this equation is weaker for manganese than for silicone. At the same time, however, as mentioned above manganese significantly increases hardenability, which in multi-phase steels results in a significant increase of the proportion of strength-increasing second phase. Therefore in a first approximation the addition of 0.1% silicone is set equal to the addition of 0.1% manganese in the sense of strength increase. For a steel of the composition according to the invention and an annealing with the time-temperature parameters according to the invention, the following equation was empirically determined for the yield strength (YS) and the tensile strength (TS):

$$YS(\text{MPa})=160.7+147.9[\%\ \text{Si}]+161.1[\%\ \text{Mn}]$$

$$TS(\text{MPa})=324.8+189.4[\%\ \text{Si}]+174.1[\%\ \text{Mn}]$$

Compared to the Pickering equation the coefficient of manganese and silicone are approximately the same for the yield strength as well as for the tensile strength, which proofs the possibility to substitute manganese by silicone.

Chromium (Cr) in solubilized form can on one hand significantly increase the hardenability of steel already in small amounts. On the other hand chromium causes precipitation hardening at a corresponding temperature profile in the form of chromium: carbides. The increase of the number of germination sites at simultaneously lowered carbon content leads to a lowering of the hardenability.

In dual-phase steels addition of chromium mainly improves the hardness penetration. In the solubilized state chromium shifts perlite and bainite transformation toward longer times and at the same time lowers the martensite start temperature.

A further important effect is that chromium significantly increases tempering resistance so that almost no strength losses occur in the zinc bath.

In addition chromium forms carbides. When chromium-iron mixed carbides are present, the austenitizing temperature has to be selected high enough prior to the hardening in order to solubilize the chromium carbides. Otherwise the increased number of nuclei may impair the hardness penetration.

Chromium also tends to form oxides on the steel surface during the annealing treatment, which may negatively affect the galvanization quality, The above-mentioned measures for adjusting the furnace regions in the continuous hot dip galvanizing, lead to a reduced formation of Cr-oxides or Cr-mixed oxides at the steel surface after the annealing.

The Cr content is therefore set to values of 0.100 to 0.700%.

For meeting the demanded mechanical properties the total content of Mn+Si+Cr is also advantageously selected depending on the sheet thickness. Advantageous for sheet thicknesses of ≤1 mm is a total content of ≥2.40 to ≤2.70%, for sheet thicknesses of 1.00 to 2.00 mm a total content of ≥2.60 to ≤2.90% and for sheet thicknesses ≥2 mm a total content of ≥2.80 to ≤3.10%.

Molybdenum (Mo): similar to chromium, addition of molybdenum improves hardenability. The perlite and bainite transformation is shifted toward longer times and the martensite start temperature is lowered. Molybdenum is also a strong carbide former, which permits the formation of finely distributed mixed carbides, among others also with titanium. Molybdenum also significantly increases the tempering resistance so that no strength losses are to be expected in the zinc bath, and causes an increase in strength of the ferrite as a result of solid solution strengthening, however less effectively than manganese and silicone.

The molybdenum content is usually limited to unavoidable steel accompanying amounts. When certain process parameters require an additional strength increase, molybdenum can be optionally added to up to 0.200%.

Copper (Cu): the addition of copper can increase tensile strength and hardness penetration. In connection with nickel, chromium and phosphorous, copper can form a protective oxide layer on the surface, which significantly reduces the corrosion rate.

In connection with oxygen copper can form deleterious oxides at the grain boundaries, which can have negative consequences in particular for hot forming processes. The copper content is therefore limited to amounts that are unavoidable during steel production.

The contents of other alloy elements such as nickel (Ni) or tin (Sn) are limited to amounts that are unavoidable during the steel production.

Aluminum (Al) is usually added to the steel in order to bind oxygen and nitrogen solubilized in the iron. In this way, oxygen is converted into aluminum oxides and aluminum nitrides. These precipitations can cause grain refinement via increasing the number of nucleation sites and thus increase the tenacity and strength values.

Aluminum nitride is not precipitated when titanium is present in sufficient amounts. Titanium nitrides have a lower formation enthalpy and are formed at higher temperatures.

In the solubilized state aluminum, like silicone, shifts the ferrite formation toward shorter times and thus enables the formation of sufficient amounts of ferrite in the dual-phase steel. In addition it suppresses the carbide formation and thus leads to a delayed transformation of the austenite. For this reason aluminum is also used as alloy element in residual austenite steels (TRIP steels) in order to substitute for a portion of the silicone by aluminum. The reason for this approach is that aluminum is less critical for the galvanization reaction than silicone.

The Al-content is therefore limited to 0.010 to maximally 0.060% and is added for deoxidizing the steel.

Niobium (Nb): Niobium has different effects in steel. During hot rolling in the finishing train it delays recrystallization by forming ultra-finely distributed precipitations, which increases the density of germination sites and a finer grain is generated after transformation. Also the proportion of solubilized niobium inhibits recrystallization. In the final product the precipitations increase strength. These precipitations can be carbides or carbonitrides. Oftentimes these precipitations are mixed carbides, into which also titanium can be integrated. This effect starts at 0.0050% and is most pronounced above 0.010% niobium. The precipitations also prevent grain growth during the (partial)austenitization in the hot dip galvanizing. Above 0.050% niobium no additional effect is expected, therefore this constitutes the uppermost limit in the invention.

Titanium (Ti): due to its high affinity to nitrogen titanium is precipitated during solidification predominantly as TiN. In addition it is present together with niobium as mixed carbide. TiN is very important for the grain size stability. The precipitations have a high temperate stability so that they, in contrast to the mixed carbides, are mostly present as particles at 1200° C., which inhibit the grain growth. Titanium also delays the recrystallization during hot rolling, however, it is hereby less effective than niobium. Titanium acts by way of precipitation hardening. The greater TiN particles are hereby less effective than the more finely distributed mixed carbides. The best effectiveness is achieved in the range from 0.005 to 0.050% titanium, therefore this constitutes the alloy range according to the invention. The proportion of titanium hereby depends on the addition of boron (see below).

Vanadium (V): because in the present alloy concept addition of vanadium is not required, the content of vanadium is limited to unavoidable steel accompanying amounts.

Boron (B): Boron is an extremely effective alloy agent for increasing hardness, which is already effective in very low amounts (above 5 ppm). The martensite start temperature remains hereby unaffected. In order to become effective, boron has to be present in solid solution. Because of its high affinity to nitrogen, the nitrogen first has to be bound, preferably by the stoichiometrically required amount of titanium. Due to its low solubility in iron, the solubilized boron is preferentially present at the austenite grain boundaries. There it partially forms Fe—B carbides, which are coherent and lower the grain boundary energy. Both effects have a delay the ferrite and perlite formation and thus increase the hardenability of the steel. Excessive amounts of boron however are deleterious because iron boride can form which has an adverse effect on the hardenability the formability and the tenacity of the material. In addition boron tends to form oxides or mixed oxides during the continuous hot dip coating, which impair the hot dip galvanizing quality. The above-mentioned measures for adjusting the furnace regions in the continuous hot dip coating reduce the formation of oxides at the steel surface.

The boron content in this invention is limited to 5 to 40 ppm.

Nitrogen (N) can be an alloy element as well as an accompanying element of the steel production. Excessive amounts of nitrogen cause a strength increase associated with a fast loss of tenacity and ageing effects. On the other hand by the targeted addition of nitrogen in connection with the micro-alloy elements titanium and niobium a fine grain hardening via titanium nitrides and niobium(carbo)nitrides can be achieved. In addition the coarse grain formation is suppressed during reheating prior to the hot rolling.

According to the invention the N-content is therefore set to ≥0.0020% to ≤0.0120%. At a sum of Ti+Nb of ≥0.10% and ≤0.050% the content of nitrogen is set to ≥0.0020% to ≤0.0100%. At a sum of Ti+Nb of >0.050% the content of nitrogen is set to ≥0.00400% to ≤00120%.

Tests conducted with the steel according to the invention have shown that in case of an inter-critical annealing between $A_{c1}$ and $A_{c3}$ or an austenitizing annealing above $A_{c3}$ with subsequent controlled cooling, a dual-phase steel with a minimal tensile strength of 750 MPa at a thickness of 0.50 to 4.00 mm can be produced, which is characterized by a sufficient tolerance toward process fluctuations.

With this, a significantly widened process window is established for the alloy composition according to the invention compared to known alloy concepts.

The annealing temperatures for the dual-phase microstructure to be achieved are between about 700 and 950° C.; depending on the temperature range, this achieves a partially austenitic (dual-phase region) microstructure or a fully austenitic microstructure (austenitic region).

The tests show that the established microstructure proportions after the inter-critical annealing between $A_{C1}$ and $A_{C3}$ or the austenitizing annealing above $A_{C3}$ with subsequent controlled cooling are maintained also after a further process step "hot dip coating" at temperatures between 400 to 470° C. for example with zinc or zinc-magnesium.

The hot dip coated material can be manufactured as hot strip as well as cold re-rolled hot strip or cold strip in the skin-passed rolled (cold re-rolled) or non-skin-pass rolled state and/or in the stretch leveled or not stretch leveled state and also in the heat treated state (overaging).

Steel strips, in the present case as hot strips, cold re-rolled hot strip or cold strip, made from the alloy composition according to the invention, are in addition characterized by a high resistance against edge-proximate crack formation during further processing.

In the past a dependence of the hole expansion ratios determined according to ISO 16630 from the sheet thickness could be established for dual phase steels. It was shown that with increasing sheet thickness greater hole expansion ratios were achieved. For this reason a similar correlation can be expected for the steel according to the invention.

The small differences in the characteristic values of the steel strip longitudinally and transversely to its rolling direction are advantageous in the subsequent use of the material. Thus the plate cutting can be conducted independent of the rolling direction (for example transversely, longitudinally and diagonally or at an angle to the rolling direction to the rolling direction).

In order to ensure the cold rollability of a hot strip produced from the steel according to the invention, the hot strip is produced according to the invention with final rolling temperatures in the austenitic range above $A_{C3}$ and coiling temperatures above the bainite start temperature (variant A).

In the case of hot strip or cold rerolled hot strip, for example with about 16% reduction, the hot strip is produced according to the invention with final roiling temperatures in the austenitic region above $A_{c3}$ and coiling temperatures below the bainite start temperature (variant B).

BRIEF DESCRIPTION OF THE DRAWING

Further features, advantages and details of the invention will become apparent from the following description of exemplary embodiments shown in the drawing.

It is shown in:

FIG. 3: an example for analytical differences of the steel according to the invention relative to a carbon-rich (C≥0.120%) and micro-alloyed comparative grade FIG. 4: examples for mechanical characteristic values (Longitudinal to the rolling direction) of the steel according to the invention FIG. 5: Results of he hole expansion tests according to ISO 16630 (sheet thickness 1.00 mm and 2.00 mm) exemplary for the steel according to the invention relative to a carbon rich (C≥1.120%) and micro-alloyed comparative grade.

FIGS. 6*a, b, c*: Temperature-time curves (annealing variants schematically).

DETAILED DESCRIPTION OF PREFERRED EMBODIMENTS

Figure 1:
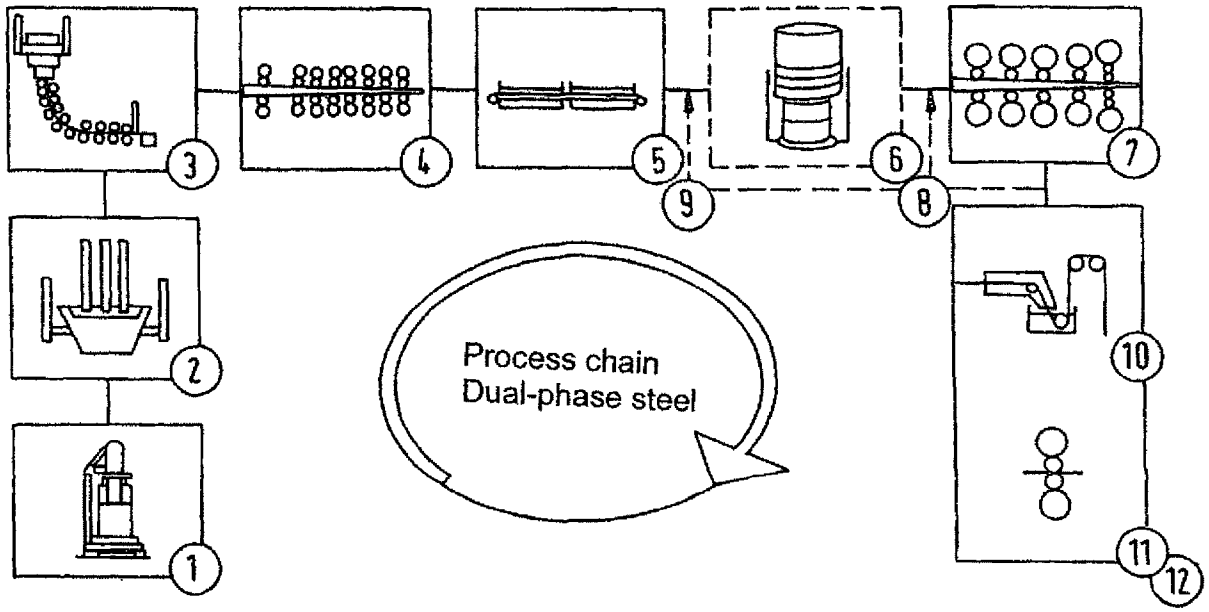
FIG. 1: a process chain (schematically) for the production of a strip from the steel according to the invention

FIG. 1 schematically shows the process chain for the production of the steel according to the invention. Shown are the different process routes relating to the invention. Up to the hot rolling (final rolling temperature) the process route is the same for all steel according to the invention, thereafter different process routes are followed depending on the desired results. For example the pickled hot strip can be galvanized or can be cold rolled with different reduction degrees and galvanized. Or soft annealed hot strip or soft annealed cold strip can be cold rolled and galvanized. Also material can be optionally processed without zinc pot (continuous annealing) with and without subsequent electrolytic galvanization.

Figure 2:
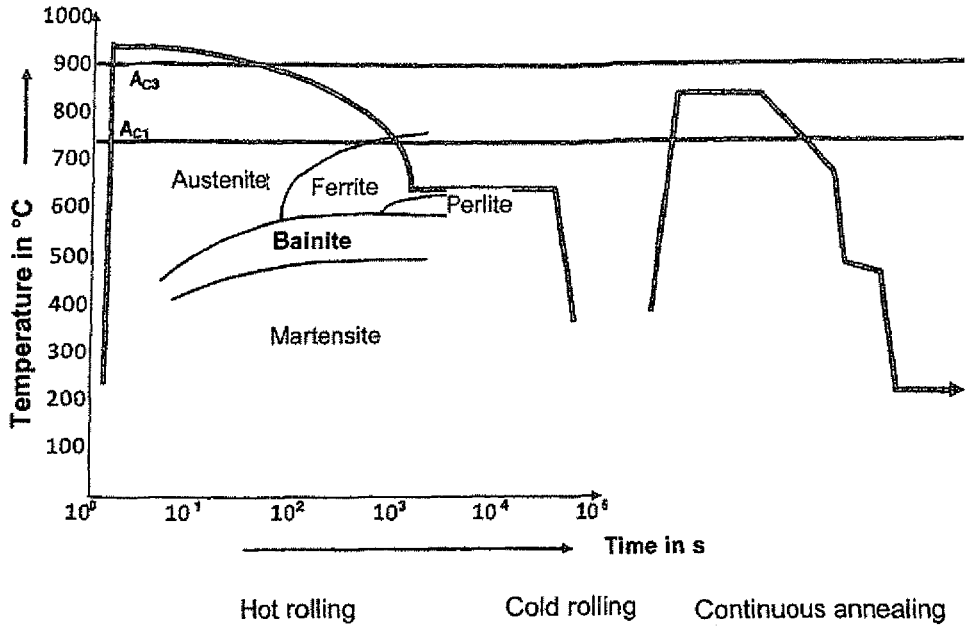
FIG. 2: a Time-temperature-course (schematically) of the process steps hot rolling and cold rolling (optionally) and continuous annealing, exemplary for the steel according to the invention

FIG. 2 shows schematically the time-temperature-course of the process steps hot tolling and continuous annealing of strips having the alloy composition according to the invention. Shown are the time and temperature dependent transformation for the hot rolling process as well as for a heat treatment after the cold rolling.

FIG. 3 exemplarily shows the essential alloy elements of the steel according to the invention, compared to the comparative grade. The steel according to the invention is significantly Si-alloyed. The comparative steel (standard grade) differs also regarding the carbon content, which is at ≥0.120%, but also regarding the elements titanium and boron.

In addition the standard grade is niobium micro-alloyed like the steel according to the invention.

FIG. 4 shows examples of mechanical characteristic values longitudinal relative to the rolling direction of the steel according to the invention.

FIG. 5 shows results of the hole expansion tests according to ISO 16630 (absolute values and relative values to the comparative grade). Shown are the results of the hole expansion tests for variant A (coiling temperature above bainite start temperature) and variant B (coiling temperature below the bainite start temperature), respectively for process 2 and process 3.

The materials have a sheet thickness of 1.00 mm or 2.000. The results apply for the test according to ISO 16630. It can be seen that the steels according to the invention have better or approximately same expansion values for punched holes as the comparative grades with same processing. The method 2 hereby corresponds to an annealing for example on a hot dip galvanizing with combined direct-fired furnace and radiant tube furnace as described in FIG. 6*b*. The method corresponds for example to a process control in a continuous annealing plant as described in FIG. 6*c*. In addition in this case a reheating of the steel can be achieved directly prior to the zinc bath by means of induction furnaces.

The different temperature profiles according to the invention within the stated range result in characteristic values or different hole expansion results that are different from each other, that are significantly improved for the method 3 according to FIG. 6*c* compared to the comparative grades. A principle difference are also the temperature time parameters during the heat treatment and the following cooling.

The FIGS. 6 schematically show three variants of the temperature time courses according to the invention at the annealing treatment and cooling and respectively different austenitization conditions.

The method 1 (FIG. 6*a*) shows the annealing and cooling of produced cold or hot rolled or cold rerolled steel strip in a continuous annealing facility. First the strips is heated to a temperature in the range of about 700 to 950° C. The annealed steel strip is then cooled from the annealing temperature to an intermediate temperate of about 200 to 250° C. with a cooling rate between about 15 and 100° C./s. A second intermediate temperature (about 300 to 500° C.) is not shown in this schematic representation. Afterwards this the steel strip is cooled at room temperature with a cooling rate between about 2 and 30° C./s until reaching room temperature or the cooling is maintained at a cooling rate of about 15 and 100° C./s until reaching room temperature.

The method 2 (FIG. 6*b*) shows the process according to method 1, however the cooling of the steel strip for the purpose of the hot dip galvanization is briefly interrupted during passage through the hot dip galvanizing container, in order to then continue the cooling with a cooling rate of between about 15 and 100° C./s until reaching an intermediate temperature of about 200 to 250° C. The steel strip is then cooled at air with a cooling rate of between about 2 and 30° C./s until reaching room temperature.

The method 3 (FIG. 6*c*) also shows the process according to method 1 in case of a hot dip coating, however, the cooling of the steel strip is interrupted by a brief brake (about 1 to 20s) at an intermediate temperature in the range of about 200 to 400° C. and is reheated to the temperature which is required for the hot dip coating (about 400 to 470° C.). Subsequent thereto the steel strip is again heated to an intermediate temperature of about 200 to 250° C. The final cooling of the steel strip at air to room temperature is conducted with a cooling rate of about 2 and 30° C./s.

For the industrial production for the hot dip galvanizing according to method 2 according to FIG. 6*b* and according to method 3 according to FIG. 6*c* the following examples are given:

EXAMPLE 1 (Cold Rerolled Hot Strip)

Variant B/2.00 mm/method 2 according to FIG. 6*b*

A steel according to the invention with 0.091% C; 0.705% Si; 1.801% Mn; 0.010% P; 0.0030% S; 0.0054% N; 0.035 Al; 0.344% Cr; 0.012% Mo; 0.016% Ti; 0.001% V; 0.016% Nb; 0.0031% B was melted in a high vacuum melting and casting facility, hot rolled in a hot rolling stand at a final rolling target temperature of 910° C. and transported into the furnace at a reel temperature of 500° C. with a thickness of 2.30 mm for a simulated reel cooling. After sand blasting the cold rolling was conducted with a cold rolling degree of 15% from 2.30 to 2.00 mm.

In an annealing simulator the steel was processed analogously to the hot dip galvanizing facility according to FIG. 6*b*.

The steel according to the invention after the heat treatment has a microstructure which consists of ferrite, martensite, bainite and residual austenite.

This steel has the following characteristic values:

| | |
|---|---|
| yield strength (Rp0.2) | 461 MPa |
| tensile strength (Rm) | 821 MPa |
| elongation at break (A80) | 15.4% |
| bake-hardening-index (BH2) | 48 MPa |
| hole expansion ratio according to ISO 16630 | 36% |

longitudinal to the rolling direction and corresponds for example to a CR440y780T-DP according to VDA 239-100.

The yield to tensile ratio Re/Rm in longitudinal direction is 56%.

EXAMPLE 2 (Cold Rerolled Strip)

Variant B/2.00 mm/method 3 according to FIG. 6*c*

A steel according to the invention with 0.091% C; 0.705% Si; 1.801% Mn; 0.010% P; 0.0030% S; 0.0054% N; 0.035 Al; 0.344% Cr; 0.012% Mo; 0.016% Ti; 0.001% V; 0.016% Nb; 0.0031% B was melted in a high vacuum melting and casting plant, hot rolled in a hot rolling stand at a final rolling target temperature of 910° C. and inserted in the furnace at a reel target temperature of 500° C. with a thickness of 2.30 mm for a simulated reel cooling. After the sand blasting the cold rolling was conducted with a cold rolling degree of 15% from 2.30 to 2.00 mm.

In an annealing simulator the steel was processed analogous to a hot dip galvanizing plant according to FIG. 6*c*.

After the heat treatment the steel according to the invention has a microstructure which consists of ferrite, martensite and residual austenite.

This steel has the following characteristic values:

| | |
|---|---|
| yield strength (Rp0.2) | 611 MPa |
| tensile strength (Rm) | 847 MPa |
| elongation at break (A80) | 10.2% |
| bake-hardening-index (BH2) | 52 MPa |
| hole expansion ratio according to ISO 16630 | 41% |

longitudinal to the rolling direction and corresponds for example to a CR570y780T-CP according to VDA 239-100. The yield to tensile ratio Re/Rm in longitudinal direction is 72%.

EXAMPLE 3 (Cold Strip)

Variant A/1.00 mm/method 2 according to FIG. 6*b*

A steel according to the invention with 0.091% C; 0.705% Si; 1.801% Mn; 0.010% P; 0.0030% S; 0.0054% N; 0.035 Al; 0.344% Cr; 0.012% Mo; 0.016% Ti; 0.001% V; 0.016% Nb; 0.0031% B was melted in a high vacuum melting and casting plant, hot rolled in a hot rolling stand at a final rolling target temperature of 910° C. and inserted in the furnace at a reel target temperature of 710° C. with a thickness of 2.02 mm for a simulated reel cooling. After the sand blasting the cold rolling was conducted with a cold rolling degree of 50% from 2.30 to 2.00 mm.

In an annealing simulator the steel was processed analogous to a hot dip galvanizing plant according to FIG. 6*b*.

After the heat treatment the steel according to the invention has a microstructure which consists of ferrite, martensite and residual austenite.

This steel has the following characteristic values:

| | |
|---|---|
| yield strength (Rp0.2) | 442 MPa |
| tensile strength (Rm) | 793 MPa |
| elongation at break (A80) | 14.5% |
| bake-hardening-index (BH2) | 51 MPa |
| hole expansion ratio according to ISO 16630 | 48% |

longitudinal to the rolling direction and corresponds for example to a CR570y780T-CP according to VDA 239-100. The yield tensile ratio Re/Rm in longitudinal direction is 56%.

EXAMPLE 4 (Cold Strip)

Variant A/1.00 mm/method 3 according to FIG. 6*c*

A steel according to the invention with 0.091% C; 0.705% Si; 1.801% Mn; 0.010% P; 0.0030% S; 0.0054% N; 0.035 Al; 0.344% Cr; 0.012% Mo; 0.016% Ti; 0.001% V; 0.016% Nb; 0,0031% B was melted in a high vacuum melting and casting plant, hot rolled in a hot rolling stand at a final rolling target temperature of 910° C. and inserted in the furnace at a reel target temperature of 710° C. with a thickness of 2.02 mm for a simulated reel cooling. After the sand blasting the cold rolling was conducted with a cold roiling degree of 50% from 2.02 to 0.99 mm.

In an annealing simulator the steel was processed analogous to a hot dip galvanizing plant according to FIG. 6*c*.

After the heat treatment the steel according to the invention has a microstructure which consists of ferrite, martensite and residual austenite.

This steel has the following characteristic values:

| | |
|---|---|
| yield strength (Rp0.2) | 520 MPa |
| tensile strength (Rm) | 780 MPa |
| elongation at break (A80) | 14.2% |
| bake-hardening-index (BH2) | 46 MPa |
| hole expansion ratio according to ISO 16630 | 67% |

longitudinal to the rolling direction and corresponds for example to a CR570y780T-CP according to VDA 239-100. The yield to tensile ratio Re/Rm in longitudinal direction is 67%.

EXAMPLE 5 (Hot Strip)

Variant A/2.00 mm/method 2 according to FIG. 6*b*

A steel according to the invention with 0.091% C; 0.705% Si; 1.801% Mn; 0.010% P; 0.0030% S; 0.0054% N; 0.035 Al; 0.344% Cr; 0.012% Mo; 0.016% Ti; 0.001% V; 0.016% Nb; 0.0031% B was melted in a high vacuum melting and casting plant, hot rolled in a hot rolling stand at a final rolling target temperature of 910° C. and inserted in the furnace at a reel target temperature of 710° C. with a thickness of 2.02 mm for a simulated reel cooling. After the sand blasting the annealing was conducted.

In an annealing simulator the steel was processed analogous to a hot dip galvanizing plant according to FIG. 6*b*.

After the heat treatment the steel according to the invention has a microstructure which consists of ferrite, martensite and residual austenite.

This steel has the following characteristic values:

| | |
|---|---|
| yield strength (Rp0.2) | 580 MPa |
| tensile strength (Rm) | 844 MPa |
| elongation at break (A80) | 10.9% |
| bake-hardening-index (BH2) | 47 MPa |
| hole expansion ratio according to ISO 16630 | 45% |

longitudinal to the rolling direction and corresponds for example to a CR570y780T-CP according to VDA 239-100. The yield to tensile ratio Re/Rm in longitudinal direction is 69%.

EXAMPLE 6 (Hot Strip)

Variant A/2.00 mm/method 3 according to FIG. 6*c*

A steel according to the invention with 0.091% C; 0.705% Si; 1.801% Mn; 0.010% P; 0.0030% S; 0.0054% N; 0.035 Al; 0.344% Cr; 0.012% Mo; 0.016% Ti; 0.001% V; 0.016% Nb; 0.0031% B was melted in a high vacuum melting and casting plant, hot rolled in a hot rolling stand at a final rolling target temperature of 910° C. and inserted in the furnace at a reel target temperature of 710° C. with a thickness of 2.02 mm for a simulated reel cooling. After sand blasting the annealing was conducted.

In an annealing simulator the steel was processed analogous to a hot dip galvanizing plant according to FIG. 6*c*.

After the heat treatment the steel according to the invention has a microstructure which consists of ferrite, martensite and residual austenite.

This steel has the following characteristic values:

| | |
|---|---|
| yield strength (Rp0.2) | 661 MPa |
| tensile strength (Rm) | 908 MPa |
| elongation at break (A80) | 10.1% |
| bake-hardening-index (BH2) | 51 MPa |
| hole expansion ratio according to ISO 16630 | 77% |

longitudinal to the rolling direction and corresponds for example to a CR570y780T-CP according to VDA 239-100. The yield to tensile ratio Re/Rm in longitudinal direction is 72%.

EXAMPLE 7 (Hot Strip)

Variant A/2.30 mm/method 2 according to FIG. 6*b*.

A steel according to the invention with 0.091% C; 0.705% Si; 1.801% Mn; 0.010% P; 0.0030% S; 0.0054% N; 0.035 Al; 0.344% Cr; 0.012% Mo; 0.016% Ti; 0.001% V; 0.016% Nb; 0.0031% B was melted in a high vacuum melting and casting plant, hot rolled in a hot rolling stand at a final rolling target temperature of 910° C. and inserted in the furnace at a coil target temperature of 500° C. with a thickness of 2.30 mm for a simulated coil cooling. After the sand blasting the annealing was conducted.

In an annealing simulator the steel was processed analogous to a hot dip galvanizing plant according to FIG. 6*b*.

After the heat treatment the steel according to the invention has a microstructure which consists of ferrite, martensite and residual austenite.

This steel has the following characteristic values:

| | |
|---|---|
| yield strength (Rp0.2) | 565 MPa |
| tensile strength (Rm) | 830 MPa |
| elongation at break (A80) | 10.7% |

-continued

| | |
|---|---|
| bake-hardening-index (BH2) | 53 MPa |
| hole expansion ratio according to ISO 16630 | 42% |

longitudinal to the rolling direction and corresponds for example to a CR570y780T-CP according to VDA 239-100. The yield to tensile ratio Re/Rm in longitudinal direction is 68%.

EXAMPLE 8 (Hot Strip)

Variant B/2.30 mm/method 3 according to FIG. 6*c*.

A steel according to the invention with 0.091% C; 0.705% Si; 1.801% Mn; 0.010% P; 0.0030% S; 0.0054% N; 0.035 Al; 0.344% Cr; 0.012% Mo; 0.016% Ti; 0.001% V; 0.016% Nb; 0.0031% B was melted in a high vacuum melting and casting plant, hot rolled in a hot rolling stand at a final rolling target temperature of 910° C. and inserted in the furnace at a reel target temperature of 500° C. with a thickness of 2.30 mm for a simulated reel cooling. After the sand blasting the annealing was conducted.

In an annealing simulator the steel was processed analogous to a hot dip galvanizing plant according to FIG. 6*c*.

After the heat treatment the steel according to the invention has a microstructure which consists of ferrite, martensite and residual austenite.

This steel has the following characteristic values:

| | |
|---|---|
| yield strength (Rp0.2) | 661 MPa |
| tensile strength (Rm) | 905 MPa |
| elongation at break (A80) | 10.6% |
| bake-hardening-index (BH2) | 49 MPa |
| hole expansion ratio according to ISO 16630 | 54% |

longitudinal to the rolling direction and corresponds for example to a CR570y780T-CP according to VDA 239-100. The yield to tensile ratio Re/Rm in longitudinal direction is 73%.

FIG. 1: process chain (schematic) for the production of a strip made of the steel according to the invention.

1. furnace process
2. secondary metallurgy
3. continuous casting
4. hot rolling
5. pickling
6. soft annealing hot strip (optional)
7. cold rolling (optional_
8. dual roller (optional)
9. soft annealing cold strip (optional)
10. hot dip galvanizing/continuous annealing
11. inline skin-passing
12.stretch leveling

What is claimed is:

1. A method, comprising:

producing a steel strip from of a steel having a composition comprising the elements, in mass %:

C≥0.0751 to ≤0.105

Si≥0.600 to ≤0.800

Mn≥1.000 to ≤1.900

Cr≥0.100 to ≤0.700

Al≥0.010 to ≤0.060

N 0.0020≤0.0120

S≤0.0030

Nb≥0.005 to ≤0.050

Ti≥0.0050 to ≤0.050

B≥0.0005 to ≤0.0040
Mo≤0.200
Cu≤0.040%
Ni≤0.040%
remainder iron and steel accompanying elements constituting smelting related impurities,
heating the steel strip during a continuous annealing to an annealing temperature in a range of about 700 to 950° C.;
cooling the annealed steel strip from the annealing temperature to a first intermediate temperature of about 300 to 500° C. with a cooling rate of between about 15 and 100° C./s; and after the cooling to the intermediate temperature treating the steel strip as set forth under a) or b):
a) cooling the steel strip to a second intermediate temperature of about 160 to 250° C. with a cooling rate of between 15 and 100° C./s and after cooling to the second intermediate temperature cooling the steel strip at air to room temperature;
b) maintaining the cooling of the steel strip with a cooling rate of between about 15 and 100° C./s from the first intermediate temperature to room temperature,
wherein a sum of contents of Mn+Si+Cr of ≥2.40 and ≤2.70%, and the steel strip has a thickness of up to 1.00 mm.

2. The method of claim 1, further comprising after the heating step and during the cooling to the first intermediate temperature step hot dip coating the steel strip in a hot dip bath, wherein the cooling to the first intermediate temperature is interrupted prior to entry into the hot dip bath, and after the cooling to the first intermediate temperature the steel strip is treated as set forth under a), wherein the second intermediate temperature is 200 to 250° C. and the cooling from the second intermediate temperature to room temperature is conducted with a cooling rate of about 2 and 30° C./s.

3. The method of claim 1, wherein the steel is treated as set forth under a), wherein the second intermediate temperature is 200 to 250° C., said method further comprising after the cooling to the second intermediate temperature and prior to the cooling to room temperature,
holding the second intermediate temperature for about 1 to 20 seconds,
reheating the steel strip to a temperature of about 400 to 470° C.,
hot dip coating the steel strip, and
cooling the steel strip to the second intermediate temperature of 200 to 250° C. with a cooling rate of between about 15 and 100° C./s,
wherein the cooling from the second intermediate temperature to room temperature is conducted with a cooling rate of about 2 and 30° C./s.

4. The method of claim 1, wherein the heating step is performed using a plant configuration comprising a directly fired furnace and a radiant tube furnace, said method further comprising:
increasing an oxidation potential during the heating by setting a CO-content in the directly fired furnace below 4%,
setting an oxygen partial pressure of an atmosphere of the radiant tube furnace according to the following equation, $$-18>\text{Log } pO_2 \geq 5*Si-0.3-2,2*Mn-0.45-0.1*Cr-0.4-12.5*(-InB)0.25,$$

wherein Si, Mn, Cr and B are corresponding alloy proportions in the steel in mass % and $pO_2$ is the oxygen partial pressure in mbar, and wherein a dew point of an overall atmosphere of the plant configuration to −30° C. or below for avoiding oxidation of the strip directly prior to immersion into a hot dip bath.

5. The method of claim 1, wherein the heating is performed with a single radiant tube furnace, and wherein the oxygen partial pressure of the atmosphere of the radiant tube furnace satisfies the following equation, $$-12>\text{Log } pO_2 \geq 5*Si-0.25-3*Mn-05-0.1*Cr-0.5-7*(-InB)0.5$$

wherein Si, Mn, Cr, and B are corresponding alloy components in the steel in mass % and $pO_2$ is an oxygen partial pressure in mbar, and wherein a dew point of an overall atmosphere of the plant configuration to −30° C. or below for avoiding oxidation of the strip directly prior to immersion into a hot dip bath.

6. The method of the claim 1, further comprising adjusting a plant throughput speed to different thicknesses of respective steel strips so that heat treatment of the respective steel strips results in similar microstructures and mechanical characteristic values.

7. The method of claim 1, further comprising after the heat treatment skin-passing the steel strip.

8. The method of claim 1, further comprising after the heat treatment stretch leveling the steel strip.

9. The method of claim 1, wherein the steel has a minimum tensile strength of 750 MPa and a yield to tensile ratio of maximally 73%.

10. The method of claim 1, wherein the Mn content is ≤1.500%.

11. A method, comprising:
producing a steel strip from of a steel having a composition comprising the elements, in mass %:
C≥0.075 to ≤0.105
Si≥0.600 to ≤0.800
Mn≥1.000 to ≤1.900
Cr≥0.100 to ≤0.700
Al≥0.010 to ≤0.060
N 0.0020≤0.0120
S≤0.0030
Nb≥0.005 to ≤0.050
Ti≥0.0050 to ≤0.050
B≥0.0005 to ≤0.0040
Mo≤0.200
Cu≤0.040%
Ni≤0.040%
remainder iron and steel accompanying elements constituting smelting related impurities,
heating the steel strip during a continuous annealing to an annealing temperature in a range of about 700 to 950° C.;
cooling the annealed steel strip from the annealing temperature to a first intermediate temperature of about 300 to 500° C. with a cooling rate of between about 15 and 100° C./s; and after the cooling to the intermediate temperature treating the steel strip as set forth under a) or b):
a) cooling the steel strip to a second intermediate temperature of about 160 to 250° C. with a cooling rate of between 15 and 100° C./s and after cooling to the second intermediate temperature cooling the steel strip at air to room temperature;
b) maintaining the cooling of the steel strip with a cooling rate of between about 15 and 100° C./s from the first intermediate temperature to room temperature, wherein a sum of contents of Mn+Si+Cr of ≥2.60 and ≤2.90%, and the steel strip has a thickness of 1.00-2.00 mm.

12. The method of claim 11, wherein the Mn content is ≤1.750%.

13. A method, comprising:

producing a steel strip from of a steel having a composition comprising the elements, in mass %:

C≥0.075 to ≤0.105
Si≥0.600 to ≤0.800
Mn≥1.000 to ≤1.900
Cr≥0.100 to ≤0.700
Al≥0.010 to ≤0.060
N 0.0020≤0.0120
S≤0.0030
Nb≥0.005 to ≤0.050
Ti≥0.0050 to ≤0.050
B≥0.0005 to ≤0.0040
Mo≤0.200
Cu≤0.040%
Ni≤0.040% remainder iron and steel accompanying elements constituting smelting related impurities, heating the steel strip during a continuous annealing to an annealing temperature in a range of about 700 to 950° C.;

cooling the annealed steel strip from the annealing temperature to a first intermediate temperature of about 300 to 500° C. with a cooling rate of between about 15 and 100° C./s; and after the cooling to the intermediate temperature treating the steel strip as set forth under a) or b):

a) cooling the steel strip to a second intermediate temperature of about 160 to 250° C. with a cooling rate of between 15 and 100° C./s and after cooling to the second intermediate temperature cooling the steel strip at air to room temperature;

b) maintaining the cooling of the steel strip with a cooling rate of between about 15 and 100° C./s from the first intermediate temperature to room temperature, wherein a sum of contents of Mn+Si+Cr of ≥2.80 and ≤3.10%, and the steel strip has a thickness of >2.00 mm.

14. The method of claim 13, wherein the Mn content is ≤1.500%.

* * * * *